United States Patent [19]

Taylor

[11] 4,022,176

[45] May 10, 1977

[54] FUEL ATOMIZER AND POSITIVE CHARGING GENERATOR

[76] Inventor: Arthur Edwin Taylor, 912 Girard Drive, Louisville, Ky. 40222

[22] Filed: June 9, 1975

[21] Appl. No.: 563,347

[52] U.S. Cl. ..... 123/141; 123/119 E

[51] Int. Cl.[2] ..... F02M 29/00

[58] Field of Search ..... 123/141, 119 E; 48/180

[56] References Cited

UNITED STATES PATENTS

| | | | |
|---|---|---|---|
| 1,061,655 | 5/1913 | Bachman | 123/141 |
| 1,178,891 | 4/1916 | Walther | 123/141 |
| 1,260,609 | 3/1918 | Warren | 123/141 |
| 1,281,899 | 10/1918 | Berg | 123/141 |
| 1,356,188 | 10/1920 | Burnham | 123/141 |
| 1,781,276 | 11/1930 | Ebert | 123/141 |
| 2,657,123 | 10/1953 | Goldman | 123/141 X |
| 3,648,676 | 3/1972 | Lowman, Jr. | 123/141 X |
| 3,682,608 | 8/1972 | Hicks | 123/119 E X |
| 3,747,581 | 7/1973 | Kolb | 123/141 |
| 3,885,539 | 5/1975 | Hicks | 123/119 E |

*Primary Examiner*—C. J. Husar
*Assistant Examiner*—Ira S. Lazarus

[57] ABSTRACT

An automotive fuel atomizing and positive charging generator includes a laminated spacer of a fuel, heat resistant material which also functions as a gasket between the carburetor and intake manifold, with circular venturi openings to allow the fuel mixture from the carburetor to pass through the non-ferrous alloy shallow cup-shaped primary screen extending across the venturi opening and around the two non-ferrous alloy baffles. The baffles are disposed below the primary screen at right angles to each other, and suitably spaced at their point of crossing. The primary screen and baffles are grounded to the carburetor base by a metal contact.

The droplets of fuel having been atomized, and in the process the mixture is expanded, and lowered in temperature enters the expansion chamber. The chamber is formed by the non-ferrous alloy cone-shaped screen which is also grounded separately to the intake manifold through a metal contact. The mixture passes through the secondary screen where it is further atomized, and a positive charge is generated as the mixture enters the intake manifold whereupon the mixture increases the efficiency of the engine through more efficient combustion.

1 Claim, 2 Drawing Figures

FUEL ATOMIZER AND POSITIVE CHARGING GENERATOR

BACKGROUND OF THE INVENTION

It is the object of the invention to provide an improved method of atomizing the fuel mixture, and providing a method of changing the negative charged fuel mixture to a positive charged mixture.

It is another object to provide within the laminated spacer, which also functions as a gasket between the carburetor and intake manifold, a primary screen of non-ferrous alloy with a shallow cup-shape which extends across the circular venturi opening. The primary screen initially atomizes the droplets of fuel, and is grounded to the carburetor base through a metal contact.

It is another object to provide two non-ferrous alloy baffles of a disimilar alloy than the primary or secondary screens. The baffles are disposed at right angles to each other, each baffle extending from one side of the venturi opening, curved under the primary screen to the opposite side of the venturi opening. The two baffles do not connect at the point where they cross below the primary screen, but are suitably spaced to provide more efficient atomization of the fuel droplets. The baffles which are in contact with the primary screen are also grounded to the carburetor base through the metal contact.

It is another object to provide an expansion chamber to allow the fuel mixture to expand, and lower in temperature before passing through the secondary screen.

It is another object to provide a secondary screen of a non-ferrous alloy formed in a cone shape which serves to form the outside extremities of the expansion chamber. The secondary screen is grounded to the intake manifold through a metal contact. The secondary screen functions to further atomize the fuel mixture and generate a positive charge.

These and other objects will be seen in the following specifications and claims in conjunction with the appended drawing in which:

DESCRIPTION OF THE INVENTION

Figure 1:
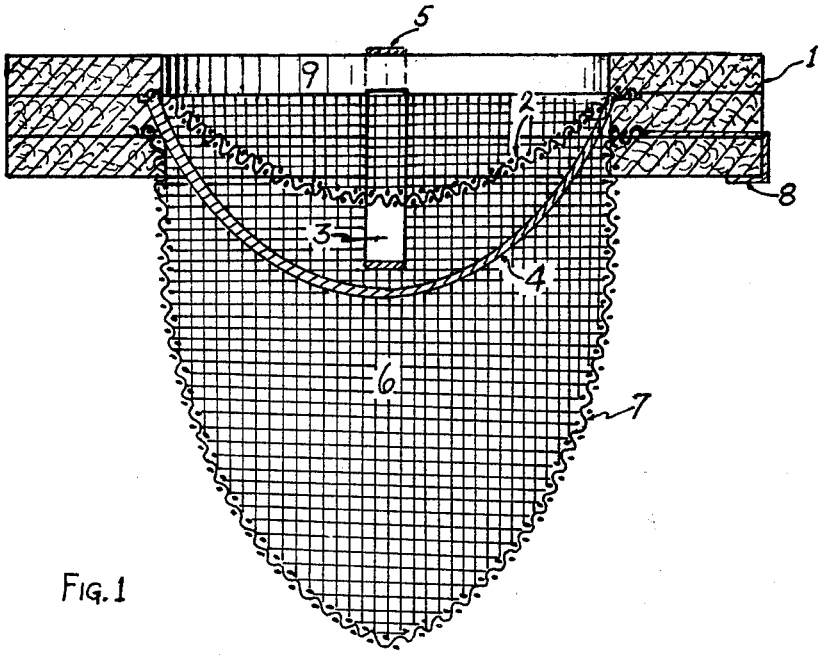
FIG. 1 is a longitudinal cross section through the fuel atomizer and positive charging generator.
Figure 2:
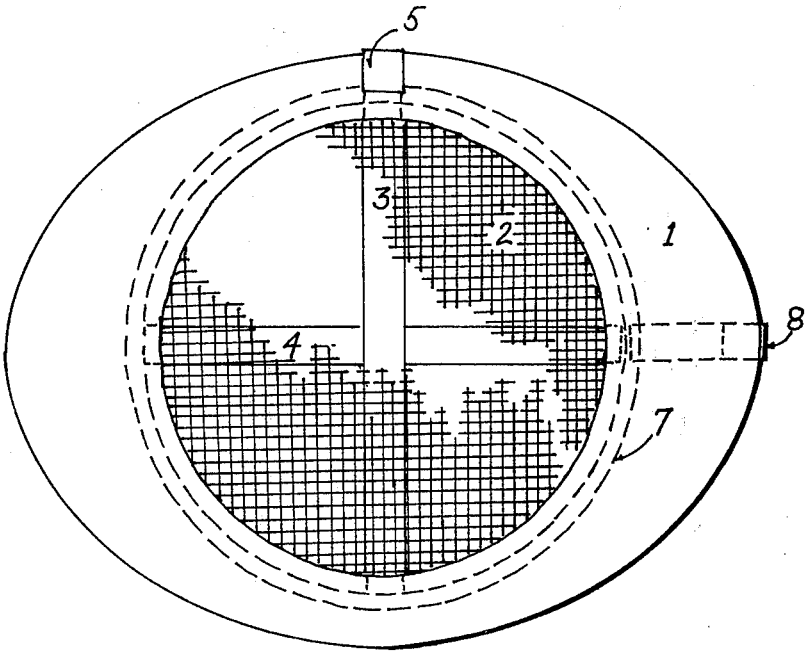
FIG. 2 is a top end view thereof.

The fuel atomizer and positive charging generator depicted in FIG. 1 is comprised of a laminated spacer 1, which may be of a fuel and heat resistant material such as a vegetable fibre, mineral fibre or other synthetic material employed in gasket or spacer applications, and also functions as a gasket between the carburetor and intake manifold. The primary screen 2 which is of a non-ferrous alloy such as aluminum or the like, is formed in a shallow cup shape and disposed in said spacer/across the venturi opening 9. The primary screen 2 is of sufficient mesh as not to restrict the fuel air mixture from the carburetor.

Two baffles 3 and 4 are disposed in said spacer/and below the primary screen 2. One baffle 3 is disposed in said spacer 1, and curved to pass below the primary screen 2 from one side of the venturi opening 9 to the opposite side of the venturi opening 9. The second baffle 4 is also disposed in said spacer and curved to pass and at right angles to and below the first baffle 3 from one side of the venturi opening 9 to the opposite side of the venturi opening 9. The baffles 3 and 4 do not connect at the point at which they cross each other at the apex of their curve. Both baffles 3 and 4 are made of a non-ferrous alloy such as brass or the like, dissimilar from the primary screen 2 and the secondary screen 7. Both the primary screen 2 and baffles 3 and 4 being in contact with each other, are grounded to the base of the carburetor through a metal contact 5 which is formed by an extension of the baffle 3, and bent at right angles to lie flat at the top of said spacer 1 which allows the contact to contact the base of the carburetor.

An expansion chamber 6 is formed below the primary screen 2 and baffles 3 and 4, by the cone-shaped non-ferrous alloy screen 7, made of aluminum or the like. The secondary screen 7 disposed in said spacer 1 is separated from the primary screen 2 and baffles 3 and 4, and is grounded separately through a metal contact to the intake manifold. The secondary screen 7 made from a non-ferrous alloy with a sufficient mesh so as not to restrict the fuel mixture, and formed in a cone shape to penetrate deep into the intake manifold.

In operation the fuel mixture from the carburetor directly enters the venturi opening 9 whereupon it passes through the primary screen 2 where the droplets of fuel are initially atomized. Having passed through the primary screen 2 the atomized fuel mixture strikes the baffles 3 and 4 which deflect the incoming mixture around the baffles thereby creating a vacuum to form on the back side of baffles 3 and 4. The vacuum thus formed, generates an eddy current which expands the mixture, further atomizes the mixture, and lowers the operating temperature of the mixture.

In the theory of operation the fuel mixture having passed through the primary screen 2, and around the baffles 3 and 4 which are grounded by a metal contact 5 separately from the secondary screen 7, passes into the expansion chamber 6. The fuel mixture as it passes into the expansion chamber 6 having been atomized and expanded and also lowered in temperature now passes through the secondary screen 7 which is of a dissimilar alloy than the baffles 3 and 4. As the mixture passes through the secondary screen 7 a positive charge is generated as the mixture enters the intake manifold with the resulting effect of increasing the combustion of the fuel in the engine cylinders.

The theory of operation is based on the phenomenon called thermoelectric generation first discovered by Seebeck, a German physicist in 1821. This theory is based on the principal that an electrical current is generated in a closed circuit of two dissimilar metals if the two junctions are maintained at different temperatures, and an organic substance is passed between them.

Having described my invention, reference should now be made to the following claims:

I claim:

1. A fuel atomizer and positive charging generator in combination with an internal combustion engine having a carburetor and intake manifold, comprised of a laminated spacer a primary shallow cup-shaped screen disposed within the said laminated spacer extending across circular venturi opening and grounded to chassis through a metal contact, a first baffle disposed within the laminated spacer and extending from one side of venturi opening curved under the primary screen and continuing to the opposite side of the venturi opening and grounded to the chassis through a metal contact, a second baffle disposed within said laminated spacer extending from one side of the venturi opening at right angles to the first baffle and curved to pass under the primary screen and first baffle and separating from the first baffle at the point where they cross, and grounded to the chassis through a metal contact, an expansion chamber formed by the outer extremities of secondary screen to allow the fuel mixture to expand and lower in temperature, a secondary cone-shaped screen disposed in the laminated spacer formed in a deep cone-shape to form the outer extremities of the expansion chamber and further atomize and positive charge the fuel mixture the secondary screen is grounded to the intake manifold through a separate metal contact, said primary screen being composed of a non-ferrous alloy with a suitable mesh to allow the flow of the fuel mixture without restriction, and atomize the droplets of fuel the primary screen being shallow cup-shaped to increase the mesh area, and eliminate the restriction of the fuel mixture, said primary screen is grounded to the chassis through the base of carburetor, said first and second baffles being composed of a non-ferrous alloy dissimilar to the primary and secondary screen, functions to further atomize, create an eddy current, expand the mixture, and lower the temperature of the mixture said baffles are grounded to the carburetor base through a metal contact, said expansion chamber to allow the expanded, lower temperature mixture to enter and further expand, said secondary screen being composed of a non-ferrous alloy with a suitable mesh to allow the flow of the fuel mixture without restriction, and grounded separately to the chassis of the vehicle through a metal contact contacting intake manifold the secondary screen further atomizes the fuel mixture and generates a positive charge.

* * * * *